US009706322B2

(12) United States Patent
Cox et al.

(10) Patent No.: US 9,706,322 B2
(45) Date of Patent: Jul. 11, 2017

(54) SYSTEM AND METHOD FOR LEAK DETECTION IN AN ENGINE SOUND TRANSPORTATION PASSAGEWAY

(71) Applicant: Honda Motor Co., Ltd., Minato-ku, Tokyo (JP)

(72) Inventors: Jared S. Cox, Raymond, OH (US); Steven M. Eich, Raymond, OH (US); Steven P. Turner, Raymond, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 109 days.

(21) Appl. No.: 14/670,196

(22) Filed: Mar. 26, 2015

(65) Prior Publication Data

US 2016/0286326 A1 Sep. 29, 2016

(51) Int. Cl.
*H04R 29/00* (2006.01)

(52) U.S. Cl.
CPC ..... *H04R 29/00* (2013.01); *H04R 2499/13* (2013.01)

(58) Field of Classification Search
CPC ..... G10K 2210/112; G10K 2210/128; G10K 2210/1282; G10K 2210/12822; F02M 35/12; F02M 35/1205; F02M 35/1211; F02M 35/1222; H04B 1/082; H04R 29/00; H04R 2499/13
USPC ..... 381/56, 58, 71.4, 71.5, 86, 365, 389; 181/166, 175, 229
See application file for complete search history.

(56) References Cited

U.S. PATENT DOCUMENTS

| | | | | |
|---|---|---|---|---|
| 6,065,329 | A * | 5/2000 | Fukada | B01D 65/102 73/37 |
| 6,192,749 | B1 * | 2/2001 | Marek | G01F 1/6845 73/204.26 |
| 6,551,389 | B2 | 4/2003 | Spannbauer et al. | |
| 6,600,408 | B1 | 7/2003 | Walter et al. | |
| 7,658,263 | B2 | 2/2010 | Jasnie et al. | |
| 7,975,802 | B2 | 7/2011 | Yokoya et al. | |
| 2006/0236973 | A1 * | 10/2006 | Seibt | F02M 35/1222 123/198 E |
| 2010/0314193 | A1 | 12/2010 | Jasnie | |
| 2013/0008737 | A1 | 1/2013 | Muller et al. | |
| 2013/0199487 | A1 * | 8/2013 | Bernard | F02B 27/001 123/184.53 |

FOREIGN PATENT DOCUMENTS

| | | | |
|---|---|---|---|
| JP | 2008184991 | * | 8/2008 |
| JP | 2008184992 A | * | 8/2008 |

* cited by examiner

*Primary Examiner* — William A Jerez Lora
(74) *Attorney, Agent, or Firm* — Arent Fox LLP

(57) ABSTRACT

Various methods and apparatuses are provided to monitor a sound transportation passageway between an engine airway and a passenger cabin, detect a rupture in an air-tight sound-permeable barrier within the sound transportation passageway separating the engine airway and the passenger cabin, and responsively effect a warning and/or a corrective action.

20 Claims, 7 Drawing Sheets

SYSTEM AND METHOD FOR LEAK DETECTION IN AN ENGINE SOUND TRANSPORTATION PASSAGEWAY

FIELD OF THE INVENTION

The present disclosure generally relates to methods and systems for leak detection in an engine sound transportation passageway, and more particularly to detecting a rupture within a barrier of the sound transportation passageway.

BACKGROUND

An engine sound transportation passageway ("passageway") can be used to communicate engine noise to a driver or other passengers within a passenger cabin of an automobile. The passageway is typically a tube of sorts and is often coupled to an engine airway (e.g., engine intake airway or exhaust airway) at one end and to the passenger cabin at the other end. Typically, an air-tight sound-permeable barrier (e.g., a diaphragm) exists within the passageway to prevent fluid communication between the engine intake airway and the interior passenger cabin. The airways on each side of the barrier are mechanically coupled through the barrier to allow sound vibrations from the engine intake to pass through the passageway into the passenger cabin.

To allow sound vibrations to be communicated, the air-tight sound-permeable barrier is typically constructed of a thin material (e.g., plastic), which allows the barrier to vibrate in response to the sound vibrations within the engine airway. However, due to its thin nature, it may be susceptible to rupturing or developing a leak. If such a rupture or leak develops, fluid communication between the engine airway and the passenger cabin can occur, which can be undesirable. Current preventative solutions exist to combat the development of a rupture, including, for example, the inclusion of mechanical stops that hinder overexpansion of the barrier to reduce stress thereon. In other approaches, vehicle manufacturers simply dictate a scheduled replacement of the barrier (e.g., every 10,000 miles or 2 years) to prevent ruptures or to repair existing ruptures that may be otherwise unnoticed.

Though suitable for at least some purposes, such approaches do not necessarily meet all needs of all application settings and/or all users. For example, current solutions are merely preventative in nature and do not account for or accommodate an actual occurrence of a rupture within the barrier.

SUMMARY

In one embodiment, a method includes monitoring a sound transportation passageway existing between an engine airway and a passenger cabin to effectuate sonic communication therebetween, the sound transportation passageway including an air-tight sound-permeable barrier between the engine airway and the passenger cabin. The method also includes detecting a rupture in the air-tight sound-permeable barrier and effecting a warning and/or a corrective action in response to detecting the rupture.

In another embodiment, an apparatus includes a sensor configured to sense a characteristic of a volume of gas within a sound transportation passageway including an air-tight sound-permeable barrier between an engine airway and a passenger cabin. The apparatus also includes a processing device communicatively coupled to the at least one sensor. The processing device is configured to receive sensor data from the sensor, determine an occurrence of a rupture in the barrier based on the received sensor data, and effect a warning and/or a corrective action in response to determining an occurrence of a rupture.

In another embodiment, a vehicle includes an engine air intake, a passenger cabin, and a sound transportation passageway. The passageway includes a first portion in fluid communication with the engine air intake, a second portion in fluid communication with the passenger cabin, a sound-permeable diaphragm defining an air-tight boundary between the first portion and the second portion, and an intake sound control valve configured to attenuate a sound level transported from the engine air intake to the passenger cabin. The vehicle also includes a sensor configured to sense a characteristic of a volume of air within the first portion and/or the second portion of the sound transportation passageway. The vehicle also includes a processing device communicatively coupled to the intake sound control valve and the sensor, the processing device configured to receive sensor data from the at least one sensor, determine an occurrence of a rupture in the diaphragm based on the received sensor data, and transmit a command to the intake sound control valve to close in response to determining the occurrence of the rupture.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
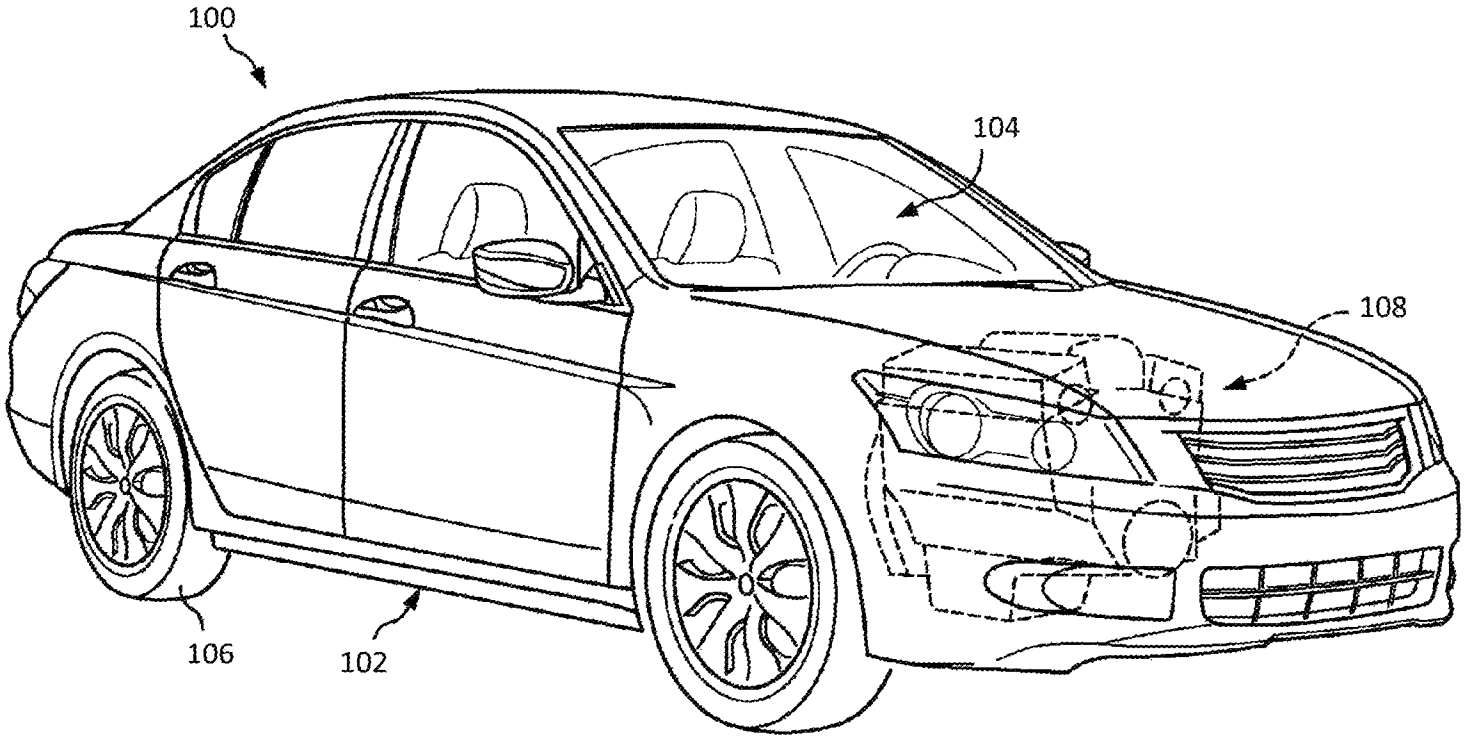
FIG. 1 is a contextual example of an application setting utilizing a sound transportation passageway in accordance with various embodiments.

Referring now to the figures, FIG. 1 illustrates an example contextual application setting that may utilize the embodiments described herein. A vehicle 100 is shown, such as an automobile, car, truck, or the like, including an exterior 102, an interior passenger cabin 104, one or more wheels and/or tires 106, and an engine 108. The engine 108 is depicted here in the front of the vehicle 100, though rear placement (or other placement) of the engine 108 (e.g., behind the passenger cabin 104) is contemplated. Often there is little to no fluid communication between the passenger cabin 104 and the exterior 102, engine bay, or elsewhere. Such fluid communication may allow for ingress or egress of air, gasses, liquid, or other substances into or out of the passenger cabin 104 to/from areas outside the passenger cabin 104. Typically, it is desirable to restrict or control the ingress and egress of air, for example, by means of a climate control system or the like.

Figure 2:
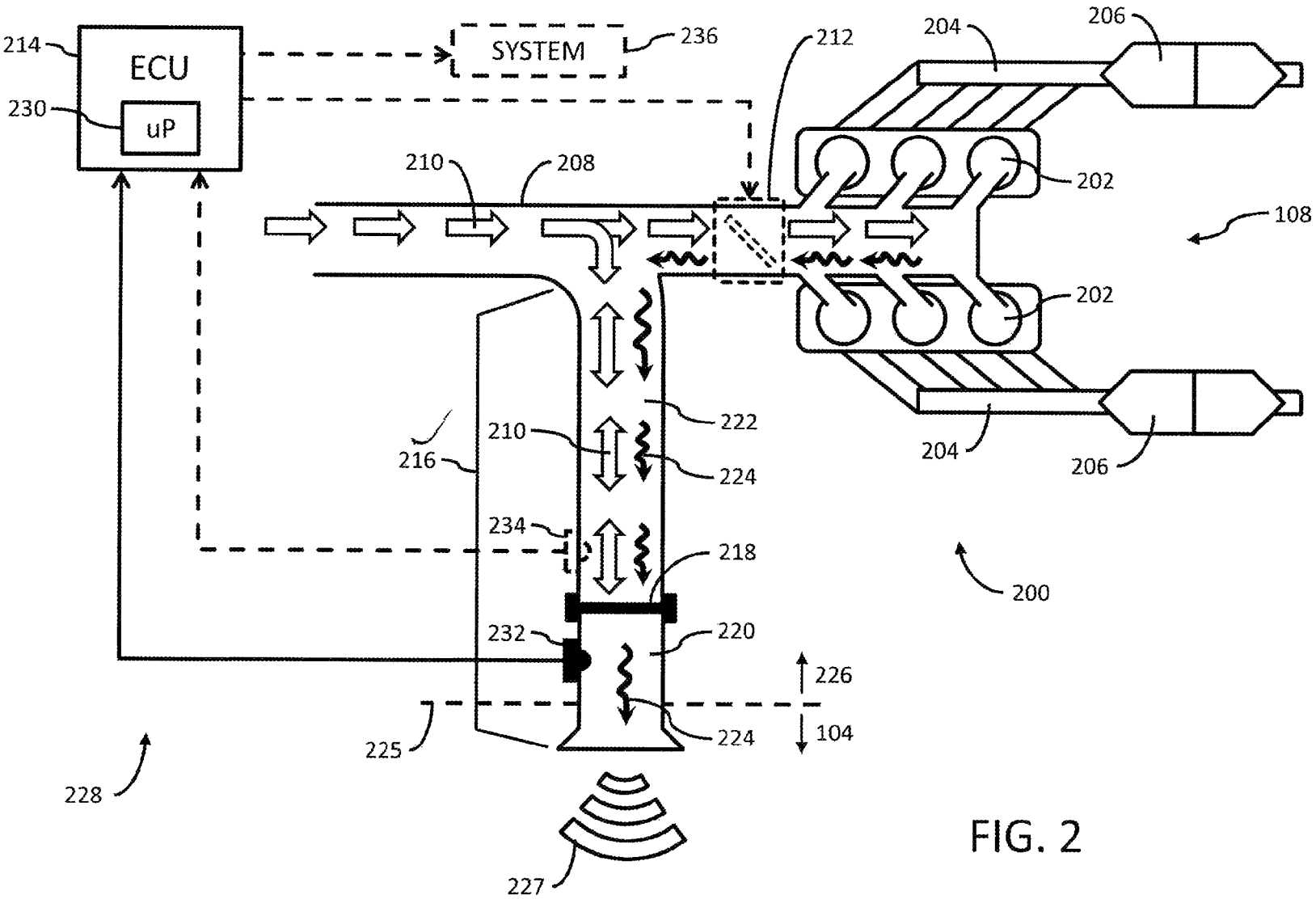
FIG. 2 is a block diagram of an apparatus in accordance with various embodiments.

Turning now to FIG. 2, an engine assembly 200 is illustrated, including various aspects of an example vehicle 100 in accordance with various embodiments. The engine assembly 200 may include an engine 108, which may further include a plurality of cylinders 202, each of which is coupled to an exhaust manifold and/or exhaust piping 204, possibly including one or more mufflers 206. The cylinders 202 are also coupled to an air intake 208 that receives air 210 from outside the vehicle 100. The air intake 208 may also include one or more air filters (not shown). A throttle valve 212 may be disposed within the air intake 208 to control the amount of air 210 that enters the cylinders. Often, the throttle valve 212 is controlled by an Engine Control Unit (ECU) 214. Each of the air intake 208 and the exhaust piping 204 and mufflers 206 comprises an engine airway. As is understood in the art, the air intake 208 generally transports gases such as air 210, while the exhaust piping 204 transports gasses such as engine exhaust.

In one embodiment, the engine assembly 200 includes a sound transportation passageway 216 existing between an engine airway and a passenger cabin 104 of the vehicle 100. As is shown in FIG. 2, in one embodiment, the sound transportation passageway 216 is a branch off of the engine air intake 208. The sound transportation passageway 216 includes an air-tight sound-permeable barrier 218. The air-tight sound-permeable barrier 218 is positioned such that it defines and separates the sound transportation passageway 216 into a first portion 220 that is in fluid communication with the passenger cabin 104 (e.g., the passenger cabin-side of the air-tight sound-permeable barrier 218) and a second portion 222 that is in fluid communication with the engine air intake 208 (e.g., the engine-side of the air-tight sound-permeable barrier 218). The air-tight sound-permeable barrier 218 may be a diaphragm made of plastic, metal, glass, or another suitable material that can vibrate to allow noise vibrations 224 to pass therethrough while maintaining an air-tight seal to prevent fluid communication between the first portion 220 and the second portion 222. The air-tight sound-permeable barrier 218 thus prevents ingress and egress of air 210 and/or other gasses into or out of the passenger cabin 104 while effectuating sonic communication between the passenger cabin 104 and the engine air intake 208. A portion of the sound transportation passageway 216 passes through an opening in a barrier 225 (possibly an engine firewall or other barrier between the passenger cabin 104 and an engine bay 226 or other area outside of the passenger cabin 104) and terminates within the passenger cabin 104. An opening in the barrier 225 may be sealed around the sound transportation passageway 216. The air-tight sound-permeable barrier 218 may exist on the passenger cabin 104 side of the barrier 225, or, as shown in FIG. 2, may exist on the engine bay 226 side of the barrier 225. So configured, engine sound 227 is introduced into the passenger cabin 104, thus enhancing the driving experience for the driver and/or the other passengers.

Although the description provided here is with regards to a sound transportation passageway 216 in fluid communication with the engine air intake 208, these teachings are understood to be applicable to other engine airways. For example, in another embodiment, the sound transportation passageway 216 may include or comprise a branch off of the exhaust piping 204. Thus, it should be understood that these teachings are not limited to the embodiment described here utilizing the air intake 208.

Figure 4:
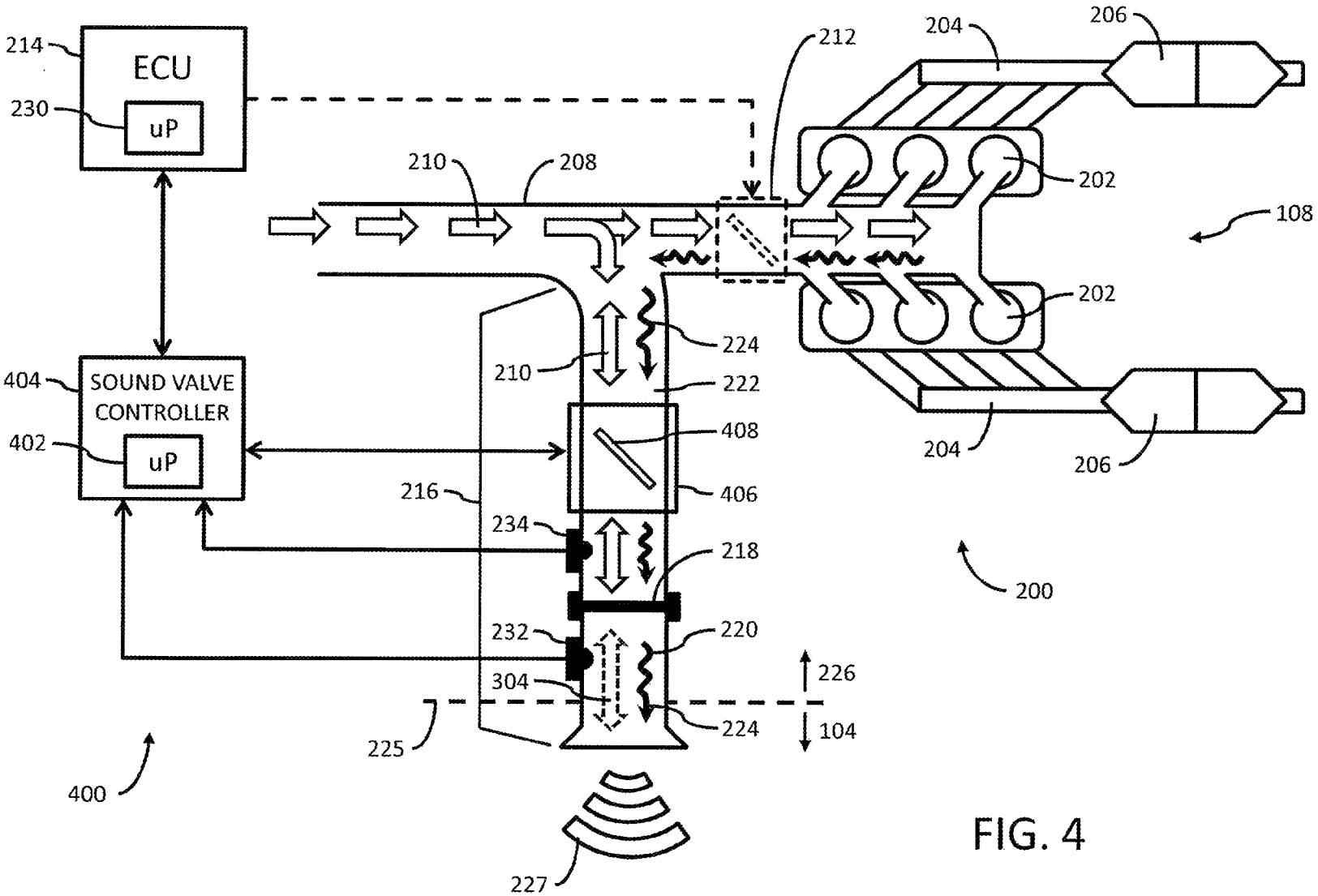
Figure 5:
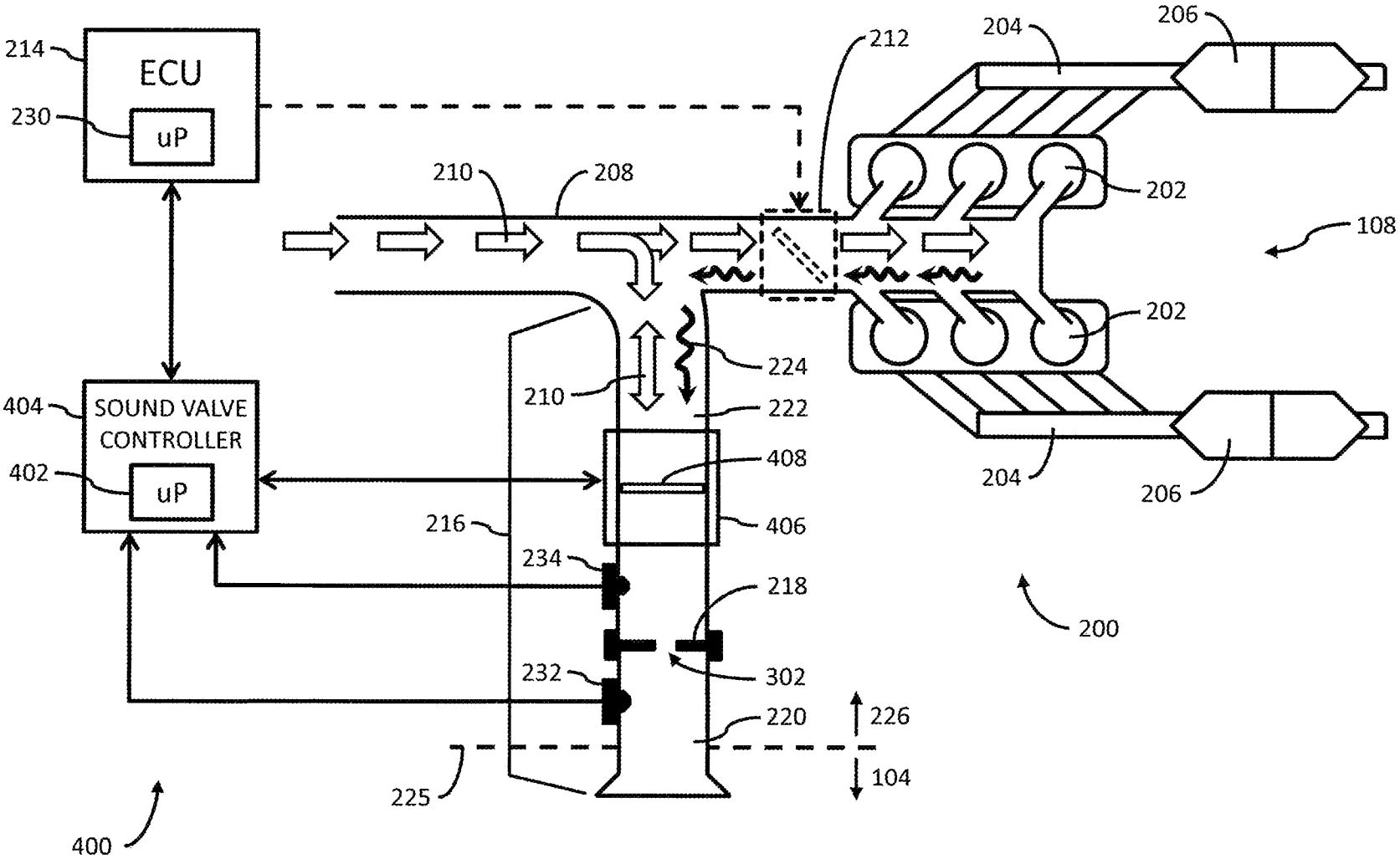

With continued reference to FIG. 2, a block diagram is presented illustrating functional aspects of an apparatus 228 in accordance with various embodiments. The apparatus 228 may be integrated within a vehicle 100 and may operate in coordination with or as part of the engine assembly 200. In one embodiment, the apparatus 228 includes a processing device 230 which may be, for example, part of an engine control unit (ECU) 214. In other embodiments as are shown in FIGS. 4 and 5, the processing device 402 may be included as part of a sound valve controller 404. Though both processing devices 230 and 402 are not required in each embodiment, if both processing devices 230 and 402 are present, the processing devices 230 and 402 may work together or separately to perform various tasks and processes described herein via known or application-specific communication protocols (e.g., CAN, UART, and the like). The processing devices 230 and 402 may comprise one or more microprocessors, microcontrollers, Field-Programmable Gate Arrays (FPGA), Application-Specific Integrated Circuits (ASIC), Digital Signal Processors (DSP), Peripheral Interface Controllers (PIC) processors, or other known processing device types or combinations thereof. The processing devices 230 and 402 may, in certain embodiments, include or be coupled to memory devices as are known in the art.

The apparatus 228 also includes at least one sensor 232 communicatively coupled to the processing device 230. In certain embodiments, at least a second sensor 234 can be communicatively coupled to the processing device 230, while in other embodiments other additional sensors may be utilized. The sensors 232, 234 can communicate with the processing device 230 via known communication protocols (e.g., CAN, UART, and the like). In one embodiment, either or both of the sensors 232, 234 are flow sensors, while in another embodiment, either or both of the sensors 232, 234 are pressure sensors. A combination of sensor types may also be utilized in other embodiments, while other sensor types may be utilized in still other embodiments (e.g., temperature sensors, microphones, leak detectors, humidity sensors, chemical make-up sensors, CO2 sensors, smoke detectors, and the like). The sensors 232, 234 are configured to sense, detect, monitor, or measure a characteristic of a volume of gas (e.g., air, exhaust, etc.) within the sound transportation passageway 216. For example, the sensors 232, 234 may sense a pressure level or flow rate of the air 210 within the sound transportation passageway 216.

The sensors 232, 234 are positioned such that at least one sensor monitors a volume of gas on either the first portion 220 of the sound transportation passageway 216 or the second portion 222 of the sound transportation passageway 216. The sensors 232, 234 may include modules that are mounted or coupled to an external surface of the sound transportation passageway 216, or otherwise exist outside of the sound transportation passageway 216, with sensing elements passing through apertures within a wall of the sound transportation passageway 216. Alternatively, the sensors 232, 234 can be mounted on an internal surface of the sound transportation passageway 216. In one embodiment as is illustrated in FIG. 2, the first sensor 232 is configured to monitor a volume of gas within the first portion 220 of the sound transportation passageway 216 while the second sensor 234 is configured to monitor a volume of gas within the second portion 222 of the sound transportation passageway 216.

The processing device 230 and/or 402 is configured or programmed to receive sensor data from either or both of the sensors 232, 234 including sensor readings or other data indicative of a current, average, or historical state of the particular measured characteristic corresponding to the monitored volume of gas within the sound transportation passageway 216. For example, the processing device 230 and/or 402 may receive first sensor data from the first sensor 232 and receive second sensor data from the second sensor 234. The processing device 230 and/or 402 is further configured or programmed to monitor the readings from the sensors 232, 234, thus effectively monitoring the characteristics of the volume of gas within the sound transportation passageway 216.

Figure 3:
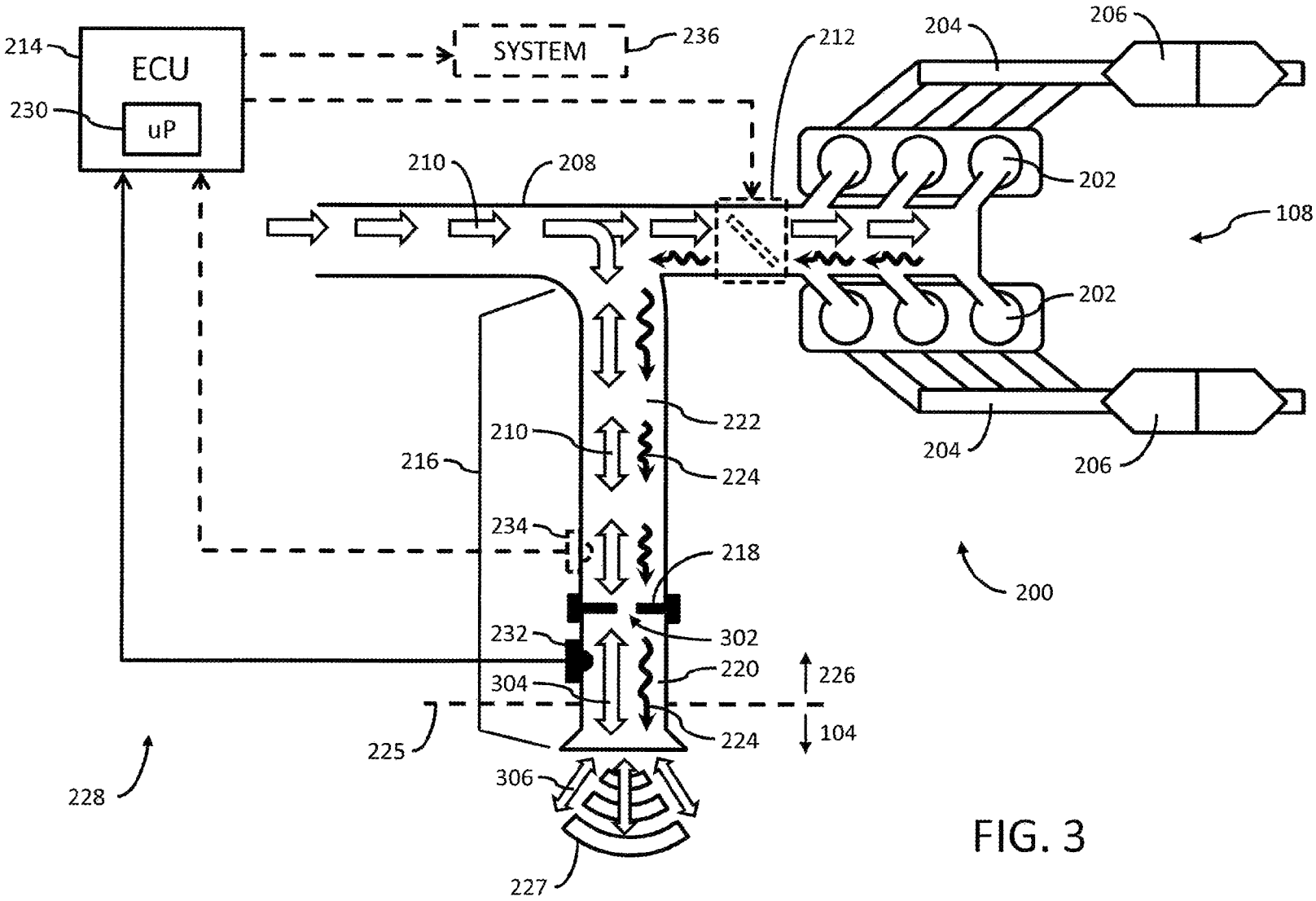
FIGS. 3-5 illustrate variations of the block diagram of the apparatus as shown in FIG. 2 in accordance with various embodiments.

Turning now to FIG. 3, other aspects of the apparatus 228 are illustrated in accordance with various embodiments. If and when a rupture 302 (e.g., leak, tear, or other failure) develops in the air-tight sound-permeable barrier 218, fluid communication may be possible between the first portion 220 and the second portion 222 of the sound transportation passageway 216. In such an instance, air 210 within the second portion 222 (e.g., the engine-side of the air-tight sound-permeable barrier 218) of the sound transportation passageway 216 can exchange with air 304 in the first portion 220 (e.g., the passenger cabin-side of the air-tight sound-permeable barrier 218) of the sound transportation passageway 216. This in turn may allow for ingress and egress of air 306 to/from the passenger cabin 104 to/from the engine air intake 208.

Although fluid communication between the passenger cabin 104 and the engine air intake 208 may not be harmful, it may produce undesirable results or effects for the driver and/or passengers. For example, pressure changes may occur within the passenger cabin 104 dependent upon the operational state of or amount of air required by the engine 108 due to the fluid communication with the engine air intake 208. Additionally, air outside of the passenger cabin 104 may enter the passenger cabin 104 without first passing through applicable filters (e.g., environmental filters) and without being subject to control mechanisms that otherwise control the environment of the passenger cabin 104 (e.g., heater or air conditioning). Further, a rupture 302 in the air-tight sound permeable barrier 218 may alter the sound characteristics of the engine noise 227 provided into the passenger cabin 104. Thus, it is advantageous to either warn of the occurrence of a rupture 302 and/or correct the rupture 302 (e.g., control, reduce, or neutralize the effects of a rupture 302) if and when it develops.

The processing device 230 and/or 402 is configured to utilize, at least in part, the readings from the sensors 232, 234 to detect or determine the occurrence of the rupture 302 within the air-tight sound-permeable barrier 218. In response to detecting the rupture 302, the processing device 230 and/or 402 can effect a warning and/or a corrective action. For example, the processing device 230 and/or 402 could perform an action on its own behalf to effect a corrective action (e.g., by effecting an action or producing a warning by a system over which is has direct or indirect control). For example, in the instance that the processing device 230 and/or 402 is part of an ECU 214, a warning may include effecting illumination of a warning light for a system that the ECU 214 controls. Similarly, a corrective action may include reducing the maximum revolutions per minute (RPMs) (e.g., a redline governor) or reconfiguring the engine 108 and/or engine air intake 208 in a manner that may reduce or neutralize the effect of the rupture 302 on the passenger cabin 104.

Alternatively, the processing device 230 and/or 402 may communicate with another system 236 to either communicate an indication of the occurrence of the rupture 302 or to communicate a command for that system 236 to produce a warning or to perform a corrective action. A warning could include, for example, an audible warning (e.g., a tone and/or a vocal warning), a visual warning (e.g., a warning light, a graphical image, or a textual message), a tactile warning (e.g., vibrating the steering wheel or the seat), or other suitable types of warnings. In such an instance, the processing device 230 and/or 402 may communicate with a system 236 such as, for example, a media system, a navigation system, an audio system, a dashboard controller, or some other system to effect the warning. In some embodiments, an engine code may be stored within the ECU 214 to be read by a diagnostic scanning tool, for example, an on-board diagnostic (e.g., OBD, OBD-II, EOBD, or the like) compatible scanner. Similarly, the processing device 230 and/or 402 may command one or more other systems 236 to perform the corrective action. For example, the processing device 230 and/or 402 may communicate with an environmental system so that it may control the effects of the rupture on the passenger cabin 104 by, for example, accounting for the exterior temperature or engine temperature (which air 306 may be at that increased or decreased temperature) when controlling the temperature of the passenger cabin 104. In another approach, the environmental system may control the flow rate of air blown into the passenger cabin 104 in a variable manner to account for and counteract any pressure changes that may occur due to the rupture 302. In another approach still, the processing device 230 and/or 402 may communicate with a window control system to open the windows or skylight slightly to neutralize any pressure change effects from the rupture 302 and/or to provide additional ventilation. Many other warning and corrective actions may be performed by varying systems 236 and/or by the processing device 230 and/or 402 itself and are contemplated by this disclosure.

Turning now to FIG. 4, additional aspects are illustrated in accordance with various embodiments. The apparatus 400 shown in FIG. 4 is a variation of the apparatus 228 shown in FIGS. 2-3. The apparatus 400 includes a valve 406 situated within the sound transportation passageway 216 (e.g., at the junction between the air intake 208 and the sound transpiration passageway 216, at the outlet of the sound transpiration passageway 216 into the passenger cabin 104, or somewhere therebetween). In one embodiment, the valve 406 is situated within the first portion 220 (the passenger cabin-side of the air-tight sound-permeable barrier 218), while in a different embodiment illustrated in FIG. 4, the valve 406 is situated within the second portion 222 (the engine-side of the air-tight sound-permeable barrier 218). In one embodiment, as is shown in FIG. 4, the valve 406 may be situated within the second portion 222 and upstream (e.g., further toward the engine air intake 208) from a second sensor 234 also located within the second portion 222, though other configurations are possible. The valve 406 may be a butterfly valve including, for example, a rotatable flap 408, though other valve styles are fully contemplated. In certain embodiments, the valve 406 is an intake sound control valve that is configured to attenuate the sonic communication or the sound level transported from the engine air intake 208 to the passenger cabin 104 along the sound transportation passageway 216. For example, the valve 406 may be configured to be closed and opened to attenuate and unattenuate a sound level transported to the passenger cabin 104. Control of the valve 406 to control the sound level may in certain embodiments be effected prior to detection of a rupture 302 in the air-tight sound permeable barrier 218.

The valve 406 may be in electrical communication with and controlled by a sound valve controller 404 including a processing device 402. The sound valve controller 404 may be communicatively linked to the ECU 214. Alternatively, the valve 406 may be in electrical communication with and controlled by the ECU 214 or controlled by both the sound valve controller 404 and the ECU 214. The processing device 402 or 230 (whichever is in control of the valve 406) may be configured to transmit a plurality of commands to the valve 406 to variably open and close the valve 406 based, at least in part, on a current operational state of the engine 200 of the vehicle 100. For example, at certain speeds and/or revolutions-per-minutes (RPMs) of the engine 200, the valve 406 may be closed or opened (partially or fully) to reduce or increase the engine sound 227 transported into the passenger cabin 104, respectively. In one approach, at wide-open throttle, the valve 406 may be fully opened to allow maximum engine sound 227 levels within the passenger cabin 104, while at lower RPMs or throttle levels, the valve 406 may be partially or fully closed to reduce the engine sound 227. In other approaches, the opposite may occur in that the valve 406 may be opened when at lower RPMs when the sound 224 output by the engine is at a lower volume while the valve 406 may be closed when at higher RPMs when the sound 224 output by the engine 200 is louder. Further, the operation of the valve 406 may be determined by, at least in part, a setting of the vehicle (e.g., a factory setting or a user-selectable setting, e.g., sport mode, quiet mode, etc.) which may influence or dictate the amount of engine sound 227 to be transported into the cabin 104. Many variations are possible as to the control of the valve 406 when functioning as a sound control valve, which variations are fully contemplated by this disclosure.

In certain embodiments, as is shown in FIG. 4, the first sensor 232 and/or the second sensor 234 may be in electrical communication with the sound valve controller 404 instead of or in addition to the ECU 214 (through the sensors 232, 234 may alternatively be in communication with only the ECU 214 in some embodiments). The processing device 230 and/or 402 within the sound valve controller 404 may process the sensor data, either in full or in part, and/or some or all of the sensor data may be relayed to the processing device 230 and/or 402 of the ECU 214 to be processed.

Turning now to FIG. 5, in one embodiment, upon detection of a rupture 302 within the air-tight sound-permeable barrier 218, the processing device 230 and/or 402 may effect a corrective action by effecting closure of the valve 406. This may entail, for example, controlling the valve 406 to close the rotatable flap 408 or transmitting a command to the valve 406 to close the rotatable flap 408, as is illustrated in FIG. 5. If a valve 406 of a type other than a butterfly valve (as is shown in FIGS. 4 and 5) is utilized, a command to effect closure of the valve 406 in whatever suitable manner as is appropriate for that particular valve style can be transmitted to the valve 406. As such, when a rupture 302 is detected, the valve 406 can be closed so as to completely or partially seal the sound transportation passageway 216, thereby eliminating or minimizing fluid communication between the passenger cabin 104 and the engine airway (e.g., engine air intake 208). This in turn prevents or minimizes ingress and egress of air 306 into and out of the passenger cabin 104 by way of the sound transportation passageway 216. In the instance of a rupture 302, closure of the valve 406 has the effect of reducing or eliminating the effects on the environment of the passenger cabin 104, the pressure variations within the passenger cabin 104, and/or the sound characteristic variations provided to the passenger cabin 104. A driver, passenger, or mechanic may then be notified of the rupture 302 either by a warning (discussed above) or by sensing that the engine sound 227 provided through the sound transportation passageway 216 has changed or is reduced or eliminated.

In some embodiments, the air-tight sound-permeable barrier 218 can be replaced (either in response to the failure or as part of a normal maintenance routine based on mileage and/or time). The processing device 230 and/or 402 may be made aware of the replacement (for example, by a mechanical clearing an OBD engine code stored within the ECU 214) and can resume normal operation of the valve 406 which may entail opening the valve 406 to allow engine sound 224 to pass therethrough once again. Alternatively, the apparatus 400 can continue to monitor the air 210 within the sound transportation passageway 216 (continuously or periodically) to determine if the rupture 302 has been repaired or otherwise remedied. For example, the valve 406 may be periodically opened (e.g., based on time, or when starting or stopping the engine 108) to determine if sensor readings have returned to levels indicative of normal operation of the system. If such a determination is made, the apparatus 400 can once again resume normal operation as described herein.

Figure 6:
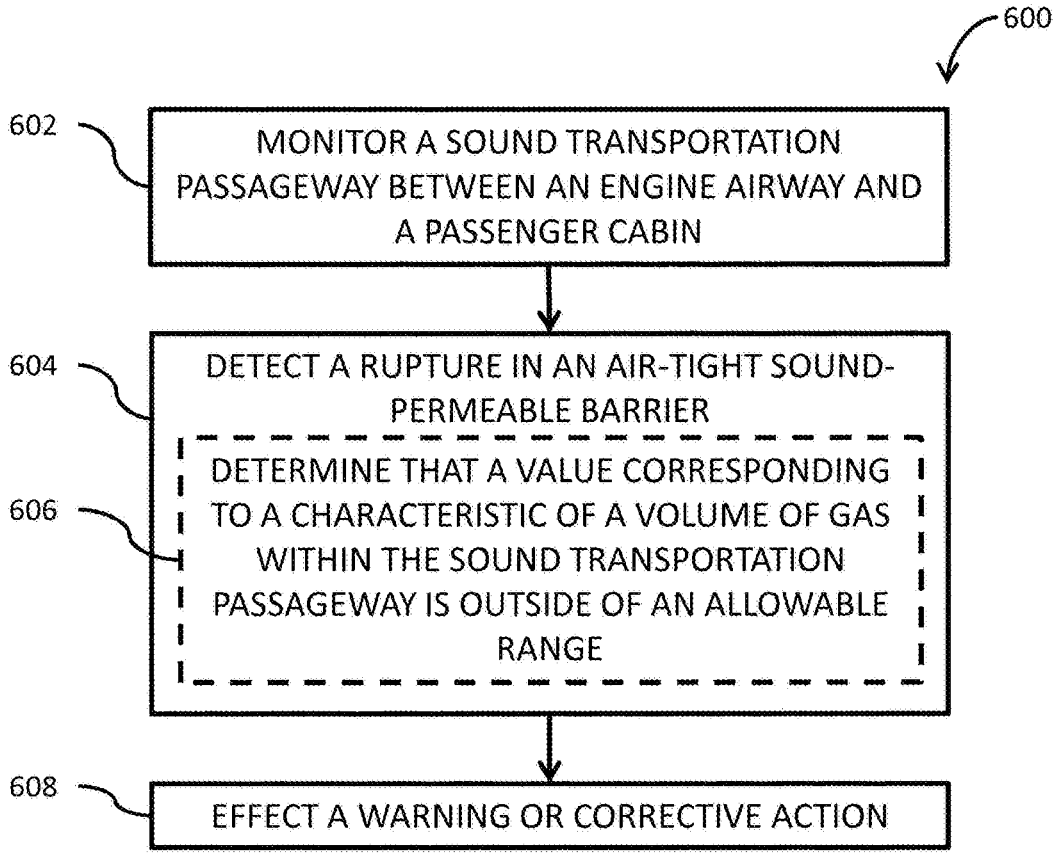
FIG. 6 is a flowchart depicting a method corresponding to the apparatus depicted in FIGS. 2-5 in accordance with various embodiments.

Turning now to FIG. 6, a flow chart is provided illustrating a method 600 for use with the apparatus 228, 400 in accordance with various embodiments. At step 602, the method 600 includes monitoring a sound transportation passageway 216 between an engine airway (e.g., engine air intake 208) and a passenger cabin 104. At step 604, the method 600 includes detecting a rupture 302 in an air-tight sound-permeable barrier 218 (e.g., a diaphragm). At step 608, the method 600 includes effecting a warning and/or a corrective action in response to detecting the rupture 302.

In one embodiment, detecting the rupture 302 in the air-tight sound-permeable barrier 218 further includes determining that a value corresponding to a characteristic of a volume of gas (e.g., air 210) within the sound transportation passageway is outside of an allowable range. In one approach, sensor 232 and/or 234 may return sensor data to the processing device 230 and/or 402 that is outside of an allowable range, which in turn indicates, at least in part, the occurrence of a rupture 302. For example, the first sensor 232 may be a flow sensor that detects the flow of air 304 or other gasses. Before the occurrence of a rupture 302, the flow of air 304 within the first portion 220 of the sound transportation passageway 216 (e.g., the passenger cabin-side of the barrier 218) may be relatively low or negligible. Thus, for example, an allowable range may include zero air flow up to a small threshold amount of air flow 304. However, in the case of a rupture 302, air flow 304 sensed by the first sensor 232 may exceed the threshold amount of air flow 304, thereby exceeding the allowable range of air flow 304. In such an instance, the processing device 230 and/or 402 may determine the occurrence of a rupture 302. Similarly, in another example, a second sensor 234 may also be a flow sensor detecting the flow of air 210 within the second portion 222 of the sound transportation passageway 216 (e.g., the engine-side of the air-tight sound-permeable barrier 218). When the air-tight sound-permeable barrier 218 is intact, the flow of air 210 past the sensor 234 should be relatively low as the second portion 222 of the sound transportation passageway 216 is a dead-end without an air outlet. Thus, in the absence of a rupture 302, the flow of air 210 may be predominantly within an allowable range. However, if a rupture 302 occurs, the air 210 within this second portion 222 of the sound transportation passageway 216 may flow through the air-tight sound-permeable barrier 218, thus causing an increase in the amount of air flow 210 at the second sensor 234. This may produce a higher sensor reading from sensor 234 and the processing device 230 and/or 402 may determine that the sensor data exceeds a threshold or is outside of an allowable range and, in turn, determine that a rupture 302 has developed.

In another example, the first sensor 232 may be a pressure sensor that detects the air pressure (e.g., ambient air pressure) within the first portion 220 of the sound transportation passageway 216 (e.g., the passenger cabin-side). Before the occurrence of a rupture 302, the pressure within the first portion 220 (which, in certain embodiments, may mirror the pressure within the passenger cabin 104) may remain relatively steady. In another approach, the pressure may follow (for example, within an allowable tolerance rage) a known, expected, or recorded pressure curve that may vary according to different operational aspects of the vehicle, including, for example, vehicle speed, window position (e.g., open or closed, distance opened), climate control operations (e.g., fresh air intake or recirculation, fan speed, etc.), engine operation, or other factors that may impact pressure within the passenger cabin 104. It should also be noted that, when used as a pressure sensor, in certain embodiments, the first sensor 232 may be located in other locations within the passenger cabin. After a rupture 302 occurs, the pressure within the first portion 220 of the sound transportation passageway 216 (and, possibly the entirety of the passenger cabin 104) may fluctuate, for example, in accordance with the operation of the engine 108. These fluctuations may exceed an allowable range, for example, a range of allowable pressure levels, a range of allowable pressure level fluctuations (e.g., an allowable amount of pressure fluctuation above and below a measured or determined average pressure level), or a range of allowable pressure level rates of change (e.g., an allowable rate at which the pressure level may fluctuate, for example, corresponding to a first-order derivative of the pressure level). If these values are outside of the allowable range, the processing device 230 and/or 402 may determine that a rupture 302 has occurred. In another embodiment, the second sensor 234 situated within the second portion 222 of the sound transportation passageway 216 may be a pressure sensor to detect the pressure within the second portion 222. Before the occurrence of a rupture 302, the pressure within the second portion 222 may be highly variable and dependent upon the current operation of the engine 108. However, after a rupture 302 occurs, the pressure within the second portion 222 may become less variable as pressure is relieved and/or pressure change rates or values are attenuated through fluid communication with the larger body of air within the first portion 220 and within the passenger cabin 104 via the rupture 302. Thus, the pressure values and/or fluctuations may be outside of (for example, below) an allow range of pressure values or fluctuation rates. If these values are outside of the allowable range, the processing device 230 and/or 402 may determine that a rupture 302 has occurred.

The particular values for the allowable range (for example, the threshold as the upper-end of an allowable range of air flow) may be set or determined based on the needs and characteristics of a particular application and/or setting. Further, the allowable ranges may have only one point (e.g., single threshold) at which values above or below that point are considered within the allowable range, two end points defining a particular allowable range, or multiple various segments of allowable ranges.

Figure 7:
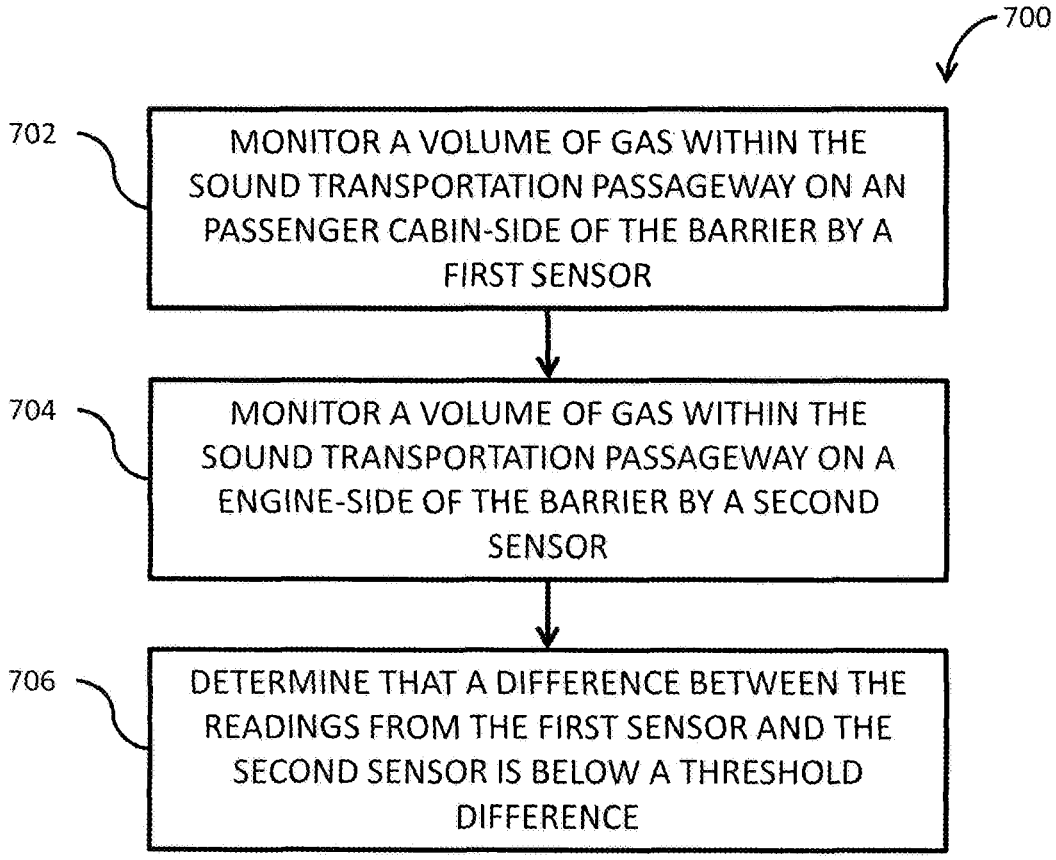
FIGS. 7-8 are flowcharts depicting variations on the method shown in FIG. 6 in accordance with various embodiments.

Turning now to FIG. 7, another method 700 is illustrated in accordance with various embodiments. The processing device 230 and/or 402 may determine that a rupture 302 has occurred based on relative sensor readings from both the first sensor 232 and the second sensor 234. For example, at step 702, the processing device 230 and/or 402 may monitor a volume of gas within the sound transportation passageway 216 in the first portion 220 (the passenger cabin-side) via first sensor data from the first sensor 232. Similarly, at step 704, the processing device 230 and/or 402 may monitor a volume of gas within the sound transportation passageway 216 in the second portion 222 (the engine-side) via second sensor data from the second sensor 234. At step 706, a difference may be calculated between the first and second sensor data, and the processing device 230 and/or 402 may determine that the difference is below a threshold difference. This may indicate that the characteristics of the volumes of air within the first portion 220 and the second portion 222 of the sound transportation passageway 216 are too similar, indicating fluid communication therebetween, in turn indicating the occurrence of a rupture 302. This threshold difference may be dependent upon (or selectively enforced based upon) the operational state of the engine 108. For example, in a high turbo-boost-situation, a difference in pressure between the air in the first portion 220 and the second portion 222 should be relatively high. However, if a rupture 302 occurs, that difference may be measurably lower, possibly falling below a difference threshold.

In making a determination that the rupture 302 has occurred, the processing device 230 and/or 402 may wait a predetermined amount of time during which the sensor data may be outside of an allowable range before making a final determination of the occurrence of a rupture 302. For example, a rupture may be determined if sensor data is outside of an allowable range (consistently or intermittently) for 1 second, 2 seconds, 5 seconds, 10 seconds, or another shorter or longer period of time. In other embodiments, the processing device 230 and/or 402 may count the number of sensor data samples that are outside of an allowable range. In other embodiments, the processing device 230 and/or 402 may determine the allowable range based on a current operation of the engine 108 coupled to the engine airway. For example, if an engine 108 is being operated at higher RPMs or with wide-open throttle, air flow 210 may be greater or pressure may be greater (e.g., high turbo-boost pressure, etc.) or less (e.g., higher vacuum) as more air 210 is being consumed by the engine 108.

In a similar manner, the sensors 232, 234 can be utilized by the processing device 230 and/or 402 to determine if the valve 406 has malfunctioned, become frozen, developed a leak, become damaged, or is otherwise inoperative. In one example, the second sensor 234 can be read to determine if its data properly corresponds to a current setting of the valve 406. For example, if the valve 406 is closed, air pressure, air flow, sound volume, or other measurable characteristics may be very low within the second portion 222 of the sound transportation passageway 216 that is downstream from the valve 406. The second sensor 234 may be located within this downstream portion. Accordingly, in this example, if the measured value (e.g., air flow, pressure, sound level, etc.) is above a threshold level corresponding to when the valve 406 is closed, the processing device 230 and/or 402 may determine that the valve 406 has malfunctioned, become frozen, developed a leak, become damaged, or is otherwise inoperative. Many other implementations are possible for utilizing the sensors 232, 234 to determine the operational status of the valve 406 and are contemplated by this disclosure.

Figure 8:
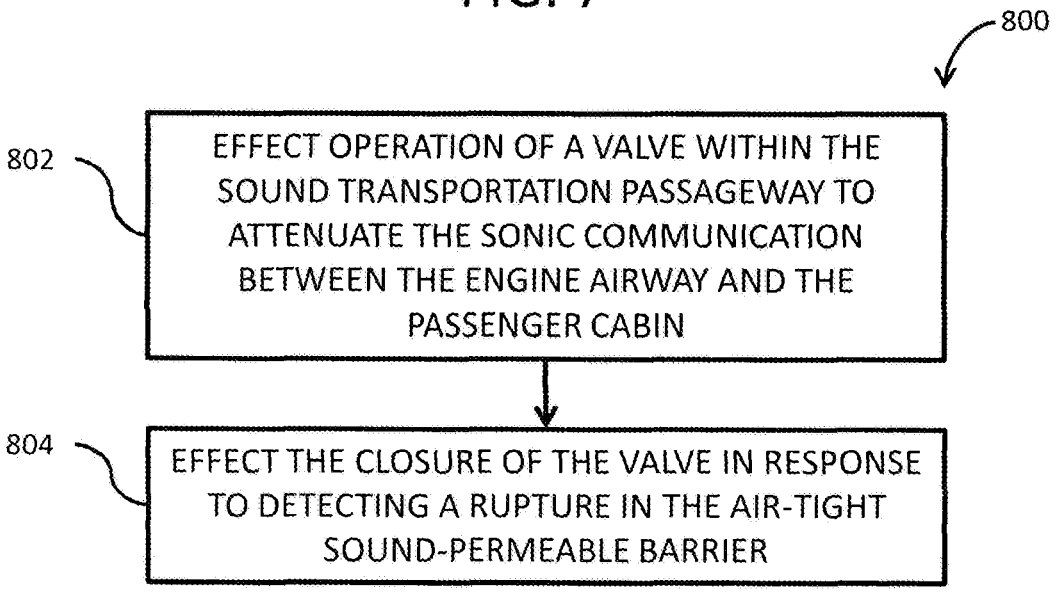

Turning now to FIG. 8, another method 800 is illustrated in accordance with various embodiments. At step 802, the method 800 includes effecting operation of a valve 406 within the sound transportation passageway 216 to attenuate the sonic communication between the engine airway (e.g., the engine air intake 208) and the passenger cabin 104. At step 804, the method 800 includes effecting the closure of the valve 406 in response to detecting a rupture in the air-tight sound-permeable barrier 218. Accordingly, a valve 406 can serve two purposes: to operate as a sound control valve to control or shape the engine sound 227 provided to the passenger cabin 104, and to operate as a sealing mechanism to eliminate or reduce the ingress and egress of air 306 into and out of the passenger cabin 104 through the sound transportation passageway 216 upon the detection of a rupture in the air-tight sound-permeable barrier 218.

Various embodiments of the present invention may be embodied in many different forms, including, but in no way limited to, computer program logic for use with a processor (e.g., a microprocessor, micro controller, digital signal processor, server computer, or general purpose computer), programmable logic for use with a programmable logic device (e.g., a Field Programmable Gate Array (FPGA) or other PLD), discrete components, integrated circuitry (e.g., an Application Specific Integrated Circuit (ASIC)), or any other means including any combination thereof.

Computer program logic implementing all or part of the functionality previously described herein may be embodied in various forms, including, but in no way limited to, a source code form, a computer executable form, and various intermediate forms (e.g., forms generated by an assembler, compiler, linker, or locator). Source code may include a series of computer program instructions implemented in any of various programming languages (e.g., an object code, an assembly language, or a high-level language such as C, C++, or JAVA) for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

The computer program may be fixed in any form (e.g., source code form, computer executable form, or an intermediate form) in a tangible storage medium, such as a semiconductor memory device (e.g., a RAM, ROM, PROM, EEPROM, or Flash-Programmable memory), a magnetic memory device (e.g., a diskette or fixed disk), an optical memory device (e.g., a CD-ROM), a PC card (e.g., PCMCIA card), or other memory device. The computer program may be distributed in any form as a removable storage medium with accompanying printed or electronic documentation (e.g., shrink wrapped software), preloaded with a computer system (e.g., on system ROM or fixed disk), or distributed from a server or electronic bulletin board over the communication system (e.g., the Internet or World Wide Web).

Hardware logic (including programmable logic for use with a programmable logic device) implementing all or part of the functionality previously described herein may be designed using traditional manual methods, or may be designed, captured, simulated, or documented electronically using various tools, such as Computer Aided Design (CAD), a hardware description language (e.g., VHDL or AHDL), or a PLD programming language (e.g., PALASM, ABEL, or CUPL).

Programmable logic may be fixed either permanently or temporarily in a tangible storage medium, such as a semiconductor memory device (e.g., a RAM, ROM, PROM, EEPROM, or Flash-Programmable memory), a magnetic memory device (e.g., a diskette or fixed disk), an optical memory device (e.g., a CD-ROM), or other memory device. The programmable logic may be distributed as a removable storage medium with accompanying printed or electronic documentation (e.g., shrink wrapped software), preloaded with a computer system (e.g., on system ROM or fixed disk), or distributed from a server or electronic bulletin board over the communication system (e.g., the Internet or World Wide Web).

The present disclosure describes preferred embodiments with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included are generally set forth as logical flow-chart diagrams. As such, the depicted order and labeled steps are indicative of one embodiment or various embodiments of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow-chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown. Some embodiments provided for are described as computer-implemented method claims. However, one of ordinary skill in the art would realize that the method steps may be embodied as computer code and the computer code could be placed on a tangible, non-transitory computer readable medium defining a computer program product.

Although the above discussion discloses various exemplary embodiments of the invention, it should be apparent that those skilled in the art can make various modifications that will achieve some of the advantages of the invention without departing from the true scope of the invention.

What is claimed is:

1. A method, comprising:

monitoring a sound transportation passageway between an engine airway and a vehicle passenger cabin and effectuating sonic communication therebetween, the sound transportation passageway including an air-tight sound-permeable barrier between the engine airway and the vehicle passenger cabin; wherein monitoring the sound transportation passageway further comprises:

detecting a rupture in the air-tight sound-permeable barrier, using at least a first sensor located in the sound transportation passageway between the air-tight sound-permeable barrier and the vehicle passenger cabin; and effecting at least one of a warning and a corrective action in response to detecting the rupture in the air-tight sound-permeable barrier.

2. The method of claim 1, wherein monitoring the sound transportation passageway includes monitoring a characteristic of a volume of gas within the sound transportation passageway.

3. The method of claim 2, wherein detecting a rupture in the air-tight sound-permeable barrier further comprises determining that a value corresponding to the characteristic of the volume of gas within the sound transportation passageway is outside of an allowable range.

4. The method of claim 3, wherein the allowable range is at least partially determined by a current operation of an engine coupled to the engine airway.

5. The method of claim 2, including monitoring the characteristic of the volume of gas within the sound transportation passageway using at least one of a flow sensor and a pressure sensor.

6. The method of claim 2, including monitoring a volume of gas within the sound transportation passageway on a passenger cabin-side of the air-tight sound-permeable barrier using the first sensor and monitoring a volume of gas within the sound transportation passageway on an engine-side of the air-tight sound-permeable barrier using a second sensor.

7. The method of claim 6, wherein detecting a rupture in the air-tight sound-permeable barrier further includes determining that a difference between a reading from the first sensor and a reading from the second sensor is below a threshold difference.

8. The method of claim 1, wherein the corrective action includes closing a valve within the sound transportation passageway.

9. The method of claim 8, including effecting operation of the valve within the sound transportation passageway to attenuate the sonic communication between the engine airway and the passenger cabin prior to detecting a rupture in the air-tight sound-permeable barrier.

10. An apparatus comprising:

at least one sensor configured to sense a characteristic of a volume of gas within a sound transportation passageway between an engine airway and a vehicle passenger cabin, the sound transportation passageway including an air-tight sound-permeable barrier, wherein the at least one sensor is located between the vehicle passenger cabin and the air-tight sound-permeable barrier;

a processing device communicatively coupled to the at least one sensor, the processing device configured to:

receive sensor data from the at least one sensor determine an occurrence of a rupture in the air-tight sound-permeable barrier based at least in part on the received sensor data; and effect at least one of a warning and a corrective action in response to determining an occurrence of a rupture in the air-tight sound-permeable barrier.

11. The apparatus of claim 10, wherein the processing device is further configured to determine that a value corresponding to the sensor data is outside of an allowable range of values.

12. The apparatus of claim 10, wherein the at least one sensor includes at least one of a flow sensor and a pressure sensor.

13. The apparatus of claim 10, wherein the at least one sensor is configured to monitor a volume of gas within the sound transportation passageway on a passenger cabin-side of the air-tight sound-permeable barrier; and a second sensor is configured to monitor a volume of gas within the sound transportation passageway on an engine-side of the air-tight sound-permeable barrier.

14. The apparatus of claim 13, wherein the processing device is further configured to:

receive first sensor data from the first sensor and receive second sensor data from the second sensor;

calculate a difference between a value corresponding to the first sensor data and a value corresponding to the second sensor data; and determine that the difference is below a threshold difference.

15. The apparatus of claim 14, wherein the threshold difference corresponds to a current operation of an engine coupled to the engine airway.

16. The apparatus of claim 10, including a valve within the sound transportation passageway, wherein the processing device is further configured to effect the corrective action by closing the valve.

17. The apparatus of claim 16, wherein the valve is configured to be closed and opened to attenuate and unattenuate a sound level transported to the passenger cabin through the sound transportation passageway.

18. A vehicle comprising:

an engine air intake;

a passenger cabin;

a sound transportation passageway comprising:

a first portion in fluid communication with the passenger cabin;

a second portion in fluid communication with the engine air intake;

a sound-permeable diaphragm defining an air-tight boundary between the first portion and the second portion; and an intake sound control valve configured to attenuate a sound level transported from the engine air intake to the passenger cabin;

at least one sensor located in the first portion of the sound transportation passageway configured to sense a characteristic of a volume of air within at least the first portion of the sound transportation passageway; and at least one processing device communicatively coupled to the intake sound control valve and the at least one sensor, the at least one processing device configured to:

receive sensor data from the at least one sensor;

determine an occurrence of a rupture in the sound-permeable diaphragm based, at least in part, on the received sensor data;

transmit a command to the intake sound control valve to close in response to determining the occurrence of the rupture.

19. The vehicle of claim 18, wherein the at least one sensor is configured to sense a characteristic of a volume of air within the first portion of the sound transportation passageway and a second sensor is configured to sense a characteristic of a volume of air within the second portion of the sound transportation passageway.

20. The vehicle of claim 18, wherein the at least one processing device is further configured to transmit a plurality of commands to the intake sound control valve to variably open and close based, at least in part, on a current operational state of an engine of the vehicle.

* * * * *